United States Patent [19]

Sjögren

[11] 4,181,303

[45] Jan. 1, 1980

[54] DARTS HAVING LOW REBOUND FREQUENCY

[76] Inventor: Kent Sjögren, Ortdrivarevägen 8, Grängesberg, Sweden

[21] Appl. No.: 723,616

[22] Filed: Sep. 15, 1976

[51] Int. Cl.[2] ..... A63B 65/02

[52] U.S. Cl. ..... 273/106.5 B; 273/106.5 C

[58] Field of Search ..... 273/106.5, 95 R; 272/106

[56] References Cited

FOREIGN PATENT DOCUMENTS

| | | | |
|---|---|---|---|
| 924641 | 3/1947 | France | 273/106.5 R |
| 38606 | 12/1923 | Norway | 272/106 |
| 82073 | 8/1919 | Switzerland | 273/106.5 B |
| 524612 | 8/1940 | United Kingdom | 273/106.5 R |
| 679970 | 9/1952 | United Kingdom | 273/106.5 R |

*Primary Examiner*—Paul E. Shapiro

*Attorney, Agent, or Firm*—Roylance, Abrams, Berdo & Farley

[57] ABSTRACT

A dart comprising an elongate body portion, a bore extending axially in said body portion, and a tip arranged for axial movement in said bore between first and second limit positions. The tip is encircled by a spring arranged in the elongate body portion. Flights are fitted to the end of the body remote from said tip and means may be provided for ejecting the flights of the dart upon axial movement of the tip to its first limit position. Preferably the tip is able to move radially in the bore between preferred limits. The advantage afforded by such a dart is that the number of rebounds occurring should the dart strike a wire of a dartboard are greatly reduced in comparison with a standard dart.

7 Claims, 2 Drawing Figures

DARTS HAVING LOW REBOUND FREQUENCY

BACKGROUND OF THE INVENTION

The game of darts is normally played with a set of three darts, which are intended to be thrown against a target for the purpose of amassing a stipulated score. The target normally has the form of a circular dartboard divided into 20 segments, numbered from 1 to 20 in a predetermined order. Extending around the perimeter of the board are two wires arranged relatively close together, these two wires being intersected by wires defining the aforementioned 20 segments. The portion of the target defined by the perimeter wires and two adjacent intersecting wires represents twice the number allotted to that particular segment. Thus if the segment in question has the value 20, a dart landing and sticking in said defined portion would score 40. Similarly, two further wires are arranged in closely adjacent circles at a distance radially inwardly of the perimeter wires. These further wires, together with the intersecting wires, define areas in which the number allotted to a particular segment is trebled. An area of the board encircling the centre of the circle is given the value 50, while a further area encircling said centre area is given the value 25.

Although relatively thin and flexible, the wires defining the various target areas of the dart board also present an obstacle to a dart aimed at one of the areas. For example, it often happens that the point of a dart will strike a defining wire, causing the dart to rebound. This means that at times not all the darts thrown will score, thereby placing the thrower at a disadvantage in relation to his competitor.

Clearly the maximum score possible with the described dart board, using three darts, is 180, this being reached by placing three darts in the treble area of the segment valued 20. Such an area, however, is relatively small and the flights of the darts placed in said area may easily block it from view. Furthermore, the flights of a dart placed in said area present an obstacle to any further dart aimed at this area and may even cause that and any subsequent dart to be deflected.

OBJECTS OF THE INVENTION

A general object of the invention is to provide a dart which at least substantially overcomes the aforementioned disadvantages.

Another object is to devise a dart exhibiting a lower frequency of rebounds than have darts of the prior art.

A further object is to provide such a dart which exhibits an increased ability to stick in the dart board when the dart happens to strike a defining wire of the dart board.

SUMMARY OF THE INVENTION

Darts according to the invention comprise an elongate body portion having a bore extending co-axially therein; flights having a portion adapted to fit into one end of said body portion; a tip adapted to be received in the end of said bore remote from said one end of said body portion and arranged for limited relative axial movement relative to said body portion between first and second predetermined positions, and a spring encircling at least part of said tip in said body portion and arranged to urge the tip forwardly.

The spring is effective to take up recoil forces acting on the tip when the tip strikes an obstacle, such as a wire defining two adjacent target areas.

The elongate body portion preferably comprises two halves, which can be screwed together or which can be joined together by some other suitable means.

The bore in one of said halves is advantageously enlarged to form a chamber for receiving the spring and the portion of the tip located in said chamber may be provided with a transversely enlarged portion effective to limit the axial movement of the tip relative to the elongate body portion at least in one direction of said relative movement.

Advantageously the chamber has a first wall defining said first predetermined position and a second wall defining said second predetermined position. Alternatively the second predetermined position may be defined by the end of the flight stem adjacent the end of the tip. In this latter case said end of said flight stem will be provided with a reinforcing member, so as to prevent damage to said end upon impact with said tip end as the tip rebounds.

Advantageously the diameter of the bore is such as to enable the tip to move radially therein.

Ejection means may be arranged between the end of the tip adjacent the flights and said flights such that axial movement of the tip towards the flights causes them to be ejected. Alternatively, the tip may be of such length as to eject the flights when moved axially thereagainst.

So that the invention will be more readily understood and optional features thereof made apparent, exemplary embodiments of the invention will now be described with reference to the accompanying schematic drawing, in which:

FIG. 1 is a view, partially in longitudinal cross-section and partially in side elevation, of a dart constructed in accordance with the invention; and FIG. 2 is a transverse cross-sectional view taken on the line A–B in FIG. 1.

DETAILED DESCRIPTION OF THE INVENTION

Figure 1:
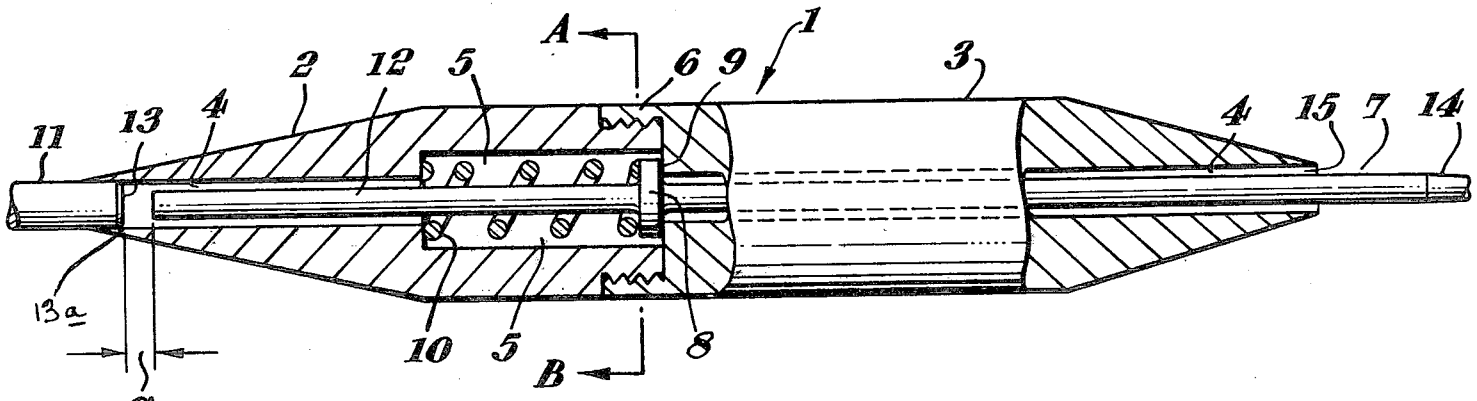
Figure 2:
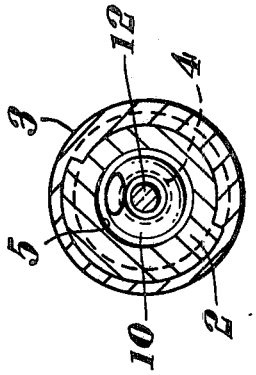

The illustrated dart comprises an elongate body portion, shown generally at 1, which in turn comprises two halves 2 and 3. Extending through the body portion 1 is a bore 4. In the half 2, the bore 4 is widened to form a chamber 5.

Arranged in the bore 4 and extending through chamber 5 is an elongate tip 7. That part of the tip 7 located within the chamber 5 is provided with a transverse enlargement 8 against which, in the assembled state of the dart, one end of a spring 10 may be brought to bear. This spring is effective to absorb recoil forces acting axially on the tip 7 towards the flights of the darts, as will be described more in detail hereinafter.

The flights (not shown) have a stem portion, part of which is shown at 11, which is adapted to be firmly received in one end of the body half 2.

The tip 7 of the illustrated dart is continuous and forms an ejector pin, as shown at 12, which terminates at a distance a from the end 13 of the flight stem 11. The distance between the mutually facing ends of the flight stem 11 and the ejector pin 12 is such as to permit sufficient penetration of the tip 7 into the target and to permit the flight to be ejected from the bore 4 upon axial movement of the body portion 1 relative to the tip 7. Although, when the tip 7 strikes the target, the body 1 will be slightly decelerated this deceleration is not appreciable and the body 1 will continue to move towards the target. When the body 1 has moved the distance relative to the pin 7 equal to the distance a, the ejector pin portion 12 of the tip 7 will engage the flight stem 11, whereupon further relative movement of the body 1 with respect to the tip 7 will cause the flights to be ejected.

Clearly the length of tip protruding beyond the leading face of the half 3 shall be sufficient to permit the tip 7 to enter the target and to permit the flights to be ejected upon said relative movement between the body portion 1 and the tip 7.

Although the bore 4 has been shown to extend completely through the elongate body 1, the bore need only extend through part of said body with the remainder of the body solid, provision being made at one end of said body for receiving the flight stem 11. In this case, no provision is made for ejecting the flights and the tip 7 will extend into the chamber 5, the part of the stem located within the chamber being encircled by the spring 10. Alternatively, the elongate body portion need not be provided with a chamber 5 for the spring 10, but the spring may be contained within the bore 4 and means may be provided for limiting the axial movement of the tip 7 between the beforementioned predetermined limit positions.

Normally, the flights of a dart are made of a plastics material and, in the case of a dart in which the second predetermined position is defined by the end of the flight stem entering the elongate body, the flight stem is liable to become damaged as a result of impact between it and a bouncing lip.

To prevent this, this end of the flight tip may be provided with an insert of hard material able to withstand repeated blows by the dart stem as it bounces within the elongate body portion. Such an insert is indicated at 13*a*.

With regard to the rebound frequency of a dart constructed in accordance with the invention, in which the tip is axially moveable relative to the elongate body portion against the force of a spring, it has been found that such a dart will rebound less frequently than will a dart with a fixed tip, i.e. a dart in which the tip is not free to move axially.

Although it is not fully understood why this is so, one reason could be as follows. The velocity of a thrown dart can be resolved into three components, a component in the Z direction, a component in the X direction, acting vertically between the 20 and the 3 on a standard board, and a component Y acting at right angles to the X component.

The wires of a dart board are relatively thin and somewhat resilient and the board on which the wires are arranged comprises a material which is soft compared with the wires and the tip of the dart. The wires will therefore not remain at rest when struck by a dart but will move slightly in the direction of at least any one of the three components of velocity. The energy required for this movement is taken from the kinetic energy of the dart, thereby reducing said kinetic energy. Whether the direction in which the dart is moving is changed or not, and the extent of any such change, depends on the angle at which the dart strikes the wire. If a dart having a rigidly mounted tip strikes the central zone of a wire, as seen in relation to the longitudinal axis of the wire, the dart will loose a great part of its kinetic energy and its direction of movement is mainly reversed. The dart will then move away from the dartboard and will fall to the ground without scoring. If such a dart strikes areas of the wire adjacent said central zone the dart will loose less kinetic energy than when it strikes said central zone. Furthermore, the change in the three components of velocity will be considerable. However the dart velocity after the bounce is not of such magnitude and direction as to enable the dart to enter the board. When a dart having a rigidly mounted point strikes the peripheral areas of the wire, however, the dart will loose but little energy as a result of striking the wire and the main component of velocity will then be the X or the Y component. This will cause the tip of the dart to slide around the wire and to enter the dartboard. Generally speaking, the transfer of kinetic energy from a moving body hitting a body at rest to said body at rest depends on the velocity of the moving body and the weight of the two bodies. When the dart tip is rigidly mounted, the transfer of energy depends on the weight of the dart and on the resilience of the wire. If, on the other hand, the tip of the dart is moveably mounted, as in accordance with the invention, this transfer of energy will depend upon the weight of the dart tip and on the resilience of the wire, unless the spring is completely compressed as the dart strikes the wire. When a moveable tip hits a wire, the amount of energy lost by the dart as a whole is therefore small compared with the amount of energy lost when the tip is rigidly mounted. Consequently enough kinetic energy remains to enable the dart to enter the board so as to score.

When a dart constructed in accordance with the invention hits the central zone of a wire, the bounce of the tip will leave the velocity of the dart body almost unchanged. The direction of movement of the tip however will be reversed. During the initial bounce, the spring will slightly reduce the velocity of the elongate body and greatly reduce the velocity of the tip. Subsequently, the spring itself or the spring together with an internal bounce of the tip against the body will reverse the direction of movement of the tip. Whether or not there is internal bounce between the body and the tip depends on the spring force and the weight of the body and the tip. The tip will then strike the surface of the wire again at the same place as it did the first time, or at a point adjacent said first place. After bouncing two or more times, possibly with internal bounces of the tip, the velocity of the body will be lost and the dart will not enter the board.

When a dart constructed in accordance with the present invention strikes the wire in areas adjacent said central zone, the course of events will be similar to those when striking said central zone. However, due to the angle between the velocity component in the Z direction and the surface of the wire, the transfer of energy and tip bounce etc. will cause the main velocity of the dart to be changed to the X or Y component. The point at which the tip strikes the wire will be further from the central zone than the point at which the tip first struck the wire. The angle between the Z component and the surface of the wire will be greater than it was when the tip first struck the wire, and the components of velocity in the X or Y directions will be greater than the component in the Z direction. Owing to the low loss of kinetic energy after each bounce, sufficient energy remains to enable the tip to enter the board, provided that it passes the wire. There is a tendency of the tip to slide off or around the wire due to the successive, varying points at which the tip strikes the wire. This tendency is increased when the point is able to move radially.

Experiments have shown that the rebound frequency of a dart constructed in accordance with the invention is influenced by the weight of the elongate body, the weight of the tip, the maximum axial relative movement of a tip with a body, the speed at which the dart is thrown and the rating of the spring. Although no general limits regarding the spring rating can be given, the spring shall preferably be able to store the rebound energy of the tip before the tip contacts its rearward movement-limiting surface, but shall be unable to cause the elongate body to be slowed to an extent such that the residual velocity of the dart is insufficient for the tip to enter the board. It has been found that the rating of the spring shall suitably lie between 100 N/m and 1000 N/m with a dart weighing, for example, between 24 grams and 30 grams. Advantageously, the spring has a rating lying between 200 and 600 N/m.

Tests have shown that the axial movment of the tip in the elongate body should lie between 4.5 and 20 mm, preferably between 10 and 15 mm. The radial movement of the tip may lie between 0.1 and 1 mm, preferably between 0.2 and 0.7 mm.

A number of tests has been carried out with darts of different weight. The results of these tests are shown in the table below. Each dart was thrown 500 times at a calculated average speed of 5 m/s. The test board comprised a base member of fibrous material and a plurality of wires arranged in grid form on the base member. The vertical wires of the grid were spaced 4 mm apart and had a length of 16 cm and a diameter of 1.65 mm. The transverse wires of the grid were spaced 5 mm apart and had a diameter of 1.5 mm. The wires covered approximately 55% of the area of the test board. The darts were dropped or thrown against the test board from a distance of 1.5 meters at the beforementioned calculated average speed of 5 m/s.

Tests A1 and A2 were carried out with darts (weight 24 grams) in which no spring was fitted but in which the tip could move radially a distance of 0.7 mm. The rebound frequency of these darts was recorded to be 9.8% and 8.6% respectively. Tests A3–A6 were carried out with darts in which respective tips were able to move axially against the force of a spring, the rating of which was 600 N/m. A marked improvement in rebound frequency was recorded, the best result being obtained with the dart used in test A6, the tip of which could move axially 14.5 mm.

Test A7 was carried out with a dart in which no spring was fitted but in which the tip could move axially 6 mm. The bounce frequency was recorded as being 9.0%, despite the ability of the tip to move axially.

The tests show that the rebound frequency of a dart is markedly reduced when the tip is able to move axially against the force of a spring. A lower rebound frequency is also obtained when the tip is able to move radially in the bore. A suitable measurement of such radial movement is 0.2–0.8 mm.

Although the invention has been described with reference to specific embodiments thereof, it is not restricted thereto, but can be modified within the scope of the following claims.

TABLE

| Test No. | Dart weight gram | Radial movement mm | Extent of axial movement of tip against force of spring mm | Spring strength N/m | Rebound frequency % |
|---|---|---|---|---|---|
| A1 | 24 | 0.7 | 0* | 00* | 9.8 |
| A2 | 24 | 0.7 | 0* | 00* | 8.6 |
| A3 | 24 | 0.65 | 4.5 | 600 | 5.6 |
| A4 | 24 | 0.7 | 8.5 | 600 | 5.2 |
| A5 | 24 | 0.7 | 9.5 | 600 | 3.4 |
| A6 | 24 | 0.7 | 14.5 | 600 | 2.8 |
| A7 | 28 | 0.3 | 6.0 | 0 | 9.0 |
| A8 | 30 | 0.1 | 8.5 | 600 | 9.4 |
| A9 | 30 | 0.3 | 10.0 | 600 | 1.9 |
| A10 | 30 | 0.3 | 7.5 | 600 | 0.6 |

The weight of the tip was, in each case, approximately 1.5 grm.
0 = No

What I claim as my invention and desire to secure by Letters Patent of the United States is:

1. A dart comprising, in combination an elongated body having a longitudinally extending bore which opens through at least the forward end of said body;

an elongated tip member disposed in said bore and protruding forwardly from said body, said tip being movable longitudinally relative to said body;

cooperating movement limiting means carried by said body and said tip for limiting relative axial movement of said body and said tip between a first position in which said tip projects forwardly from said body to its utmost extent and a second position in which said tip is partially retracted but still projects forwardly from said body sufficiently to penetrate and remain stuck in a dart board; and said limiting means including resilient means engaged between said body and said tip for biasing said tip forwardly towards said first position, said resilient means exerting on said tip a biasing force such that, upon impact of the dart on a dart board with attendant deceleration of said tip, said body can move forwardly relative to said tip until said tip occupies said second position, said biasing force and the distance between said first and second positions being such as to enable said tip to penetrate a dart board even when the tip encounters an obstruction having the characteristics of a target-defining wire on the surface of the dart board.

2. A dart comprising in combination an elongated body having a longitudinally extending bore which opens through that end of the body which leads when the dart is thrown, a portion of said bore being widened to form a chamber;

an elongated tip member disposed in said bore and projecting through said end of the body, said tip member having a transversely enlarged portion located in said chamber; and a spring in said chamber between an end of the chamber and a spring in said chamber between an end of the chamber and said transversely enlarged portion of said tip member, said spring urging said tip member forwardly relative to said body towards the forward end of said chamber;

the combination of said forward end of said chamber, said transversely enlarged portion of said tip member and said spring constituting limiting means for limiting relative axial movement between said body and said tip member;

the transverse cross-sectional dimensions of said bore are greater than the transverse cross-sectional dimensions of said tip member to permit limited movement of said tip member generally radially relative to said bore, said spring, enlarged portion and chamber being such that the tip may penetrate a dart board even when the tip encounters an obstruction having the characteristics of a target-defining wire on the surface of a dart board.

3. A dart according to claim 2, wherein said bore extends completely through said body, the dart further comprising flight means having a stem releasably retained in the end of said bore which trails when the dart is thrown, said stem and the adjacent end of said tip member being spaced apart by a predetermined distance when said enlarged portion of said tip member engages the forward end of said chamber, said predetermined distance being significantly smaller than the distance of relative axial movement allowed by said limiting means whereby, when the dart is thrown and said tip member strikes a target, relative axial movement between said body and said tip member causes axial engagement between the tip member and said stem of the flight means and flight means is ejected from said bore.

4. A dart according to claim 1, wherein said body comprises two portions secured together end-to-end with one of said portions including the end of the body which leads when the dart is thrown and the other of said portions including the end which trails, said other portion including the widened portion of said bore and a first transverse wall which defines the trailing end of said chamber, said one portion including a second transverse wall which forms the leading end of said chamber;

said spring is engaged between said first transverse wall and said transversely enlarged portion of said tip member; and the portion of said bore extending between said second transverse wall and the end of the body which leads is of slightly larger transverse dimension than is the portion of said tip member which extends therethrough.

5. A dart having flights that break away upon impact of the dart with a target, comprising:

(a) an elongated dart body having an axial bore;

(b) flights yieldingly held to one end of the body and having a part projecting into the bore;

(c) a point yieldingly held to the other end of the body in said axial bore and having a part projecting therefrom;

(d) and a stem slidably disposed in the bore between the flight and point with one end engaged by the point and the other end adjacent the flight part projecting into the bore;

whereby impact of the dart on a target causes the body to override the point, sliding the stem rearwardly in the body to eject the flights from the body.

6. A dart comprising, in combination an elongated body having a longitudinally extending bore which opens through at least the forward end of said body;

an elongated tip member disposed in said bore and protruding forwardly from said body, said tip being movable longitudinally and transversly relative to said body;

cooperating movement limiting means carried by said body and said tip for limiting relative radial movement and for limiting relative axial movement of said body and said tip between a first position in which said tip projects forwardly from said body to its utmost extent and a second position in which said tip is partially retracted but still projects forwardly from said body sufficiently to penetrate and remain stuck in a dart board; and said limiting means including resilient means engaged between said body and said tip for biasing said tip forwardly towards first position, said resilient means exerting on said tip a biasing force such that, upon impact of the dart on a dart board with attendant deceleration of said tip, said body can move forwardly relative to said tip until said tip occupies said second position;

said biasing force, limiting means and the distance between said first and second positions being such as to enable said tip to penetrate a dart board even when the tip encounters an obstruction having the characteristics of a target-defining wire on the surface of the dart board.

7. A dart comprising, in combination an elongated body having a longitudinally extending bore which opens through at least the forward end of said body;

an elongated tip member disposed in said bore and protruding forwardly from said body, said tip being movable longitudinally relative to said body; and means for reducing dart bounce when said tip encounters an obstruction having the characteristics of a target-defining wire on the surface of a dart board;

said means for reducing dart bounce including cooperating movement limiting means carried by said body and said tip for limiting relative axial movement of said body and said tip between a first position in which said tip projects forwardly from said body to its utmost extent and a second position in which said tip is partially retracted but still projects forwardly from said body sufficiently to penetrate and remain stuck in a dart board, said limiting means including resilient means engaged between said body and said tip for biasing said tip forwardly towards said first position, said resilient means exerting on said tip a biasing force such that, upon impact of the dart on a dart board with attendant deceleration of said tip, said body can move forwardly relative to said tip until said tip occupies said second position, said biasing force and the distance between said first and second positions being such that said tip may penetrate a dart board even when the tip encounters an obstruction having the characteristics of a target-defining wire on the surface of the dart board.

* * * * *